US012151150B1

(12) United States Patent
Hoderny et al.

(10) Patent No.: US 12,151,150 B1
(45) **Date of Patent: *Nov. 26, 2024**

(54) GROUND DRONE-BASED SPORTS TRAINING AID

(71) Applicants: Envelope Sports, LLC, Atlanta, GA (US); SURVICE Engineering Company, Belcamp, MD (US)

(72) Inventors: Pat Hoderny, Atlanta, GA (US); Joey Roberts, Mission Viejo, CA (US); Chris Hoderny, McKees Rocks, PA (US); Paul Aubrey Troth, Aldie, VT (US); Joseph Murphy, Palos Verdes Estates, CA (US); Ryan Michael Walter, Townson, MD (US); Mark Thomas Butkiewicz, North East, MD (US); Kyle David Herr, Quarryville, PA (US); Robert Eric Baltrusch, Newark, DE (US)

(73) Assignee: Envelope Sports, LLC, Atlanta, GA (US)

( * ) Notice: Subject to any disclaimer, the term of this patent is extended or adjusted under 35 U.S.C. 154(b) by 51 days.

This patent is subject to a terminal disclaimer.

(21) Appl. No.: 17/990,809

(22) Filed: Nov. 21, 2022

Related U.S. Application Data

(63) Continuation of application No. 16/992,692, filed on Aug. 13, 2020, now Pat. No. 11,504,593.

(51) Int. Cl.

| | |
|---|---|
| ***A63B 69/00*** | (2006.01) |
| ***A63B 24/00*** | (2006.01) |
| ***A63B 63/06*** | (2006.01) |

(52) U.S. Cl.
CPC ..... *A63B 69/002* (2013.01); *A63B 24/0021* (2013.01); *A63B 63/06* (2013.01);
(Continued)

(58) Field of Classification Search
None
See application file for complete search history.

(56) References Cited

U.S. PATENT DOCUMENTS 5,513,841 A * 5/1996 Takagi ..... A63B 69/3694 473/168
7,288,033 B1 * 10/2007 Jordan ..... A63B 63/00 D21/705

(Continued)

*Primary Examiner* — Sunit Pandya

(57) ABSTRACT

A ground traversing, electrically driven drone travels along a preprogrammed path that corresponds to pass catcher's travel path during a play, matching the pass catcher's speed and run cuts. The play is wirelessly communicated to the drone by a handheld electronic device located remote of the drone. A target is located on the drone so that a quarterback can throw a football at the target in order to refine the quarterback's timing and accuracy for the play. Sensors onboard the drone track both the football's and quarterback's speed and travel trajectories so that such data can be collected, along with the drone's travel path, and stored onboard the drone's control unit and eventually fed into 3-D reconstruction software for analysis by the quarterback and coaching staff. The target rotates so that the target either faces in a fixed direction or constantly faces the quarterback during execution of drone's maneuvers.

20 Claims, 6 Drawing Sheets

(52) U.S. Cl.
CPC ..... *A63B 2024/0025* (2013.01); *A63B 2024/0028* (2013.01); *A63B 2024/0037* (2013.01); *A63B 2220/05* (2013.01); *A63B 2220/833* (2013.01); *A63B 2225/50* (2013.01); *A63B 2243/007* (2013.01)

(56) References Cited

U.S. PATENT DOCUMENTS

| | | | | |
|---|---|---|---|---|
| 7,435,194 | B1 * | 10/2008 | Lewis | A63F 7/0608 473/422 |
| 8,951,106 | B2 * | 2/2015 | Crowley | A63B 71/06 463/3 |
| 9,555,306 | B2 * | 1/2017 | Lewis | A63B 71/0619 |
| 9,605,926 | B1 * | 3/2017 | Means | G01S 19/14 |
| 9,623,564 | B2 * | 4/2017 | Al-Shaikhi | B25J 9/1607 |
| 9,782,648 | B2 * | 10/2017 | DeCarlo | A61B 5/6895 |
| 9,829,882 | B2 * | 11/2017 | MacGregor | B62D 61/00 |
| 2004/0158358 | A1 * | 8/2004 | Anezaki | G05D 1/0221 700/264 |
| 2006/0058921 | A1 * | 3/2006 | Okamoto | G05D 1/0223 701/25 |
| 2007/0061041 | A1 * | 3/2007 | Zweig | G05D 1/0261 700/245 |
| 2009/0187299 | A1 * | 7/2009 | Fregene | G05D 1/0094 701/23 |

* cited by examiner

GROUND DRONE-BASED SPORTS TRAINING AID

This application is a Continuation of U.S. patent application Ser. No. 16/992,692, filed on Aug. 13, 2020.

BACKGROUND OF THE INVENTION

1. Field of the Invention

The present invention relates to a ground based, autonomous drone that is programmed to travel along a pre-programmed route that mimics a pass catcher's route to allow a pass thrower to attempt to hit a target resident on the drone. The system also provides feedback on the pass thrower's performance as it tracks the pass thrower and the travel path of the football.

2. Background of the Prior Art

In any sports, team or solo, the ability to perform at ever greater levels comes with practice, practice, practice. The more an athlete or a team practices, the more they improve their skills and the greater their ability to have a consistent winning record. While physically getting onto the sports field for workouts is of prime importance, another important aspect of athletic improvement is analysis. A quarterback can get on the field and throw long range passes to the outside receiver all day long. However, if each pass has a built-in flaw, then performance improvement may not occur. Coaches analyze an athlete's performance on the practice field and offer tips for improvement, however, a coach's eyes can only see so much, especially in a highspeed game such as football. Additionally, unless a coach is a meticulous record keeper, which record keeping requires the coach to take their eyes off the practice field, much of what a coach sees may be forgotten when it comes time to sit down with the athlete for analysis.

In the game of football, much attention is given to arguably the most important position on the field, the quarterback. The quarterback will spend much time with the offense learning and perfecting various plays, sometimes for purely mechanical development and sometimes against the team's defense for more real field experience. However, the best quarterbacks also put in substantial time performing lonely work, that is, behind the scenes work, sharpening throwing skills and timing. Such lonely work is performed with a single pass catcher, not the entire offense. The quarterback has the pass catcher run various play routes in order to allow the quarterback to sharpen his timing and throw accuracy. This highly effective system helps quarterbacks improve their throwing skills, but is not without its shortcomings.

In a basic throw, catch, repeat workout, the quarterback is mobile, however, he is at a relatively low exertion rate. However, the pass catcher is running down the field at full speed and must also return back to the line of scrimmage for the start of the next play. As such, the pass catcher requires a rest period, often after each play, thereby slowing the pace and momentum of the practice session.

To address these issues, devices have been proposed wherein the pass catcher is replaced with a motorized unit that travels down the field with some form of target for the quarterback to aim at. As the device is motorized and not human, the device can remain at peak potential as long as its source of motorized power, typically a battery, remains. While such devices are effective, they are limited in scope in that such a device either travels along a straight path or can make rudimentary turns via remote control which turns may align the target into a position relative to the quarterback such that quarterback cannot effectively hit the target—for example, if the target travels straight down the field and then turns 45 degrees for a cross route, the target may be at such an angle that the quarterback cannot effectively hit the target. Such limitations do not provide the quarterback the ability to gain practice experience for highs speed complex plays where the pass catcher makes sharp cuts and directional reversals.

What is needed is a device that allows a quarterback to engage in the lonely work of throwing to a pass catcher running a specific play in order to allow the quarterback to sharpen his throw accuracy and timing skills, which device addresses the above-mentioned limitations in the art. Specifically, such a device must be able to continuously run at the speeds needed by the quarterback for any play desired. Such a device must be able to make sharp pre-programmed turns as well as directional reversals in the same manner as a human pass catcher would perform such turns and reversals while allowing the target to be properly aligned to allow the quarterback a realistic opportunity to hit the target with a proper throw.

SUMMARY OF THE INVENTION

The ground drone-based sports training aid of the present invention addresses the aforementioned needs in the art by providing an electrically operated ground vehicle, acting as a pass target, that has the speed and agility to run any passing route the quarterback desires in order to allow the quarterback to develop accuracy and timing proficiency without the need for a human pass catcher who has limited endurance. The ground drone-based sports training aid adjusts its target so that the quarterback always has an appropriate visual line on the target and is able to hit the target with the proper throw. The ground drone-based sports training aid has appropriate onboard systems that track all aspects of each play so that a postmortem of the quarterback's session can be performed in the locker room with the coach.

The ground drone-based sports training aid of the present invention is comprised of a ground traversing drone that has a series of wheels driven by at least one electric drive motor. The drone travels along a path preprogrammed into a control unit located onboard the drone by an electronic device located remoted of the drone that sends the travel path commands to the drone wirelessly. The drone is capable of traveling any path that a human pass catcher can at the same speeds. The control unit is in communication with the drive motor in order to provide a series of speed input commands to the drive motor based on the path preprogrammed into the control unit. A target is located onboard the drone. A sensor pack is located on the drone and tracks a first speed and travel trajectory for a period of time of a first object (football) remote from the drone and stores a first data set of the first speed and travel trajectory for the period of time on board the control unit. The sensor pack also tracks a second speed and travel trajectory for the period of time of a second object (pass thrower) remote from the drone and stores a second data set of the second speed and travel trajectory for the period of time on board the control unit. The drone may be steered by variable outputs of the wheels or by an independent steering assembly connected to at least a subset of the wheels—the motor input different speeds and/or torques (including reverse torque—one wheel rotating for forward travel and another wheel rotating for reverse travel)

into each wheel to which the motor is connected—recognizing that more than one motor may be present and the motors work in unison for their respective wheel sets that they control. The target rotates, via a mast motor, so as to be constantly facing in a defined direction. The defined direction may be a fixed direction such as either always facing the endzone or always facing the initial position of the football. The defined direction may be a variable direction based on a location of the second object, such as the quarterback. If the defined direction is a variable direction, the sensor, tracking the second object, constantly inputs a location data related to the location of the second object to the control unit so that the control units sends an appropriate rotation signal to the mast motor in order to maintain the target in the defined direction. An obstacle sensor is located on the drone such that if the object sensor detects an obstacle in the travel path of the drone, the drone takes evasive action to avoid impacting the obstacle. The control unit transmits the first data set and the second data set to the electronic device wherein the first data set and the second data set are each fed into 3-D reconstruction software. Of course the travel path of the drone is also included as input into the 3-D reconstruction data so that a coach or quarterback can view a complete analysis of each play including the quarterback's position, the ball's trajectory and speed, the ball's location with respect to the sweet spot of the target at impact (or miss of the target) and the travel path of the drone itself.

BRIEF DESCRIPTION OF THE DRAWINGS

Similar reference numerals refer to similar parts throughout the several views of the drawings.

DESCRIPTION OF THE PREFERRED EMBODIMENT

Figure 1:
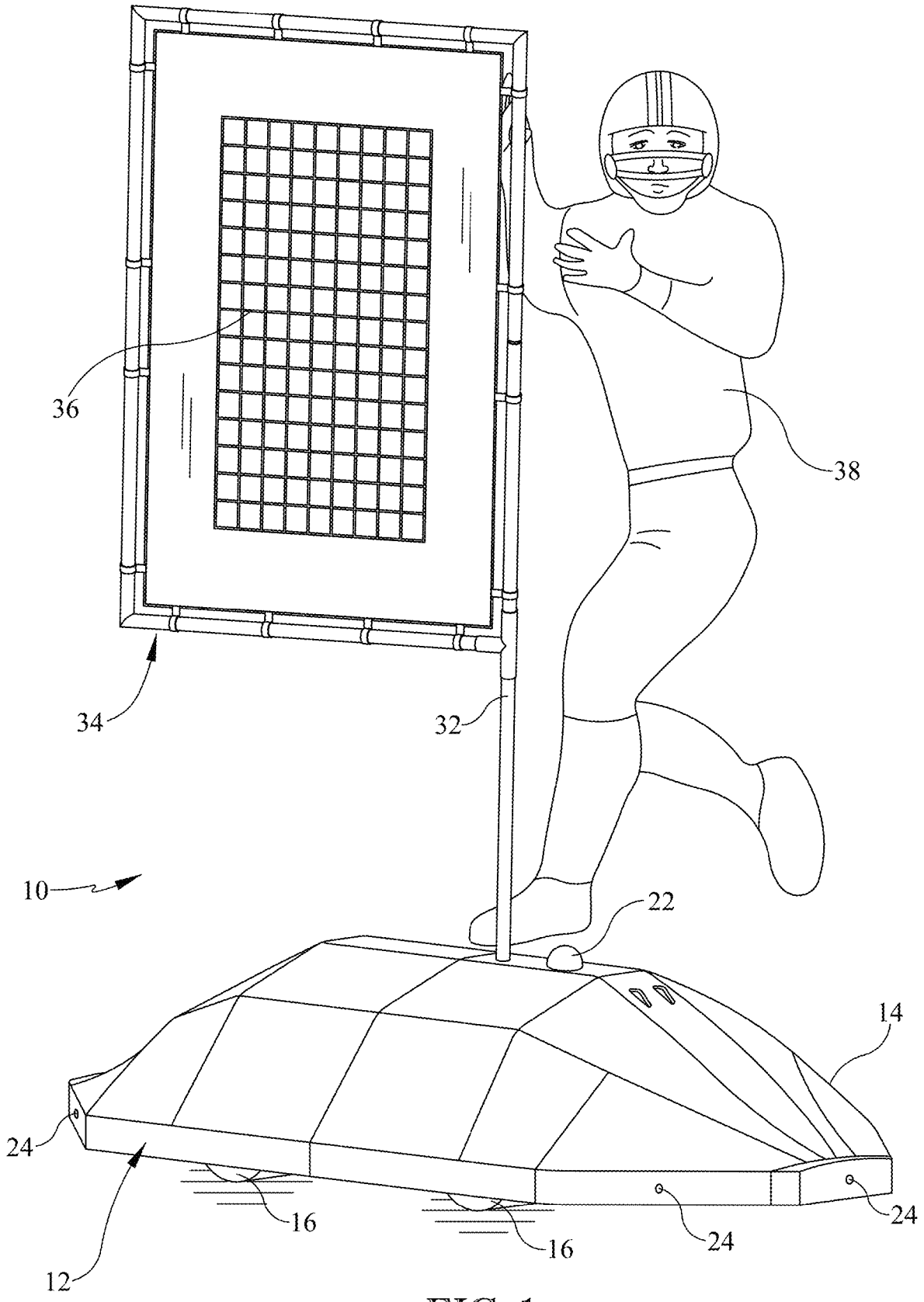
FIG. 1 is a perspective view of the ground drone-based sports training aid of the present invention.
Figure 2:
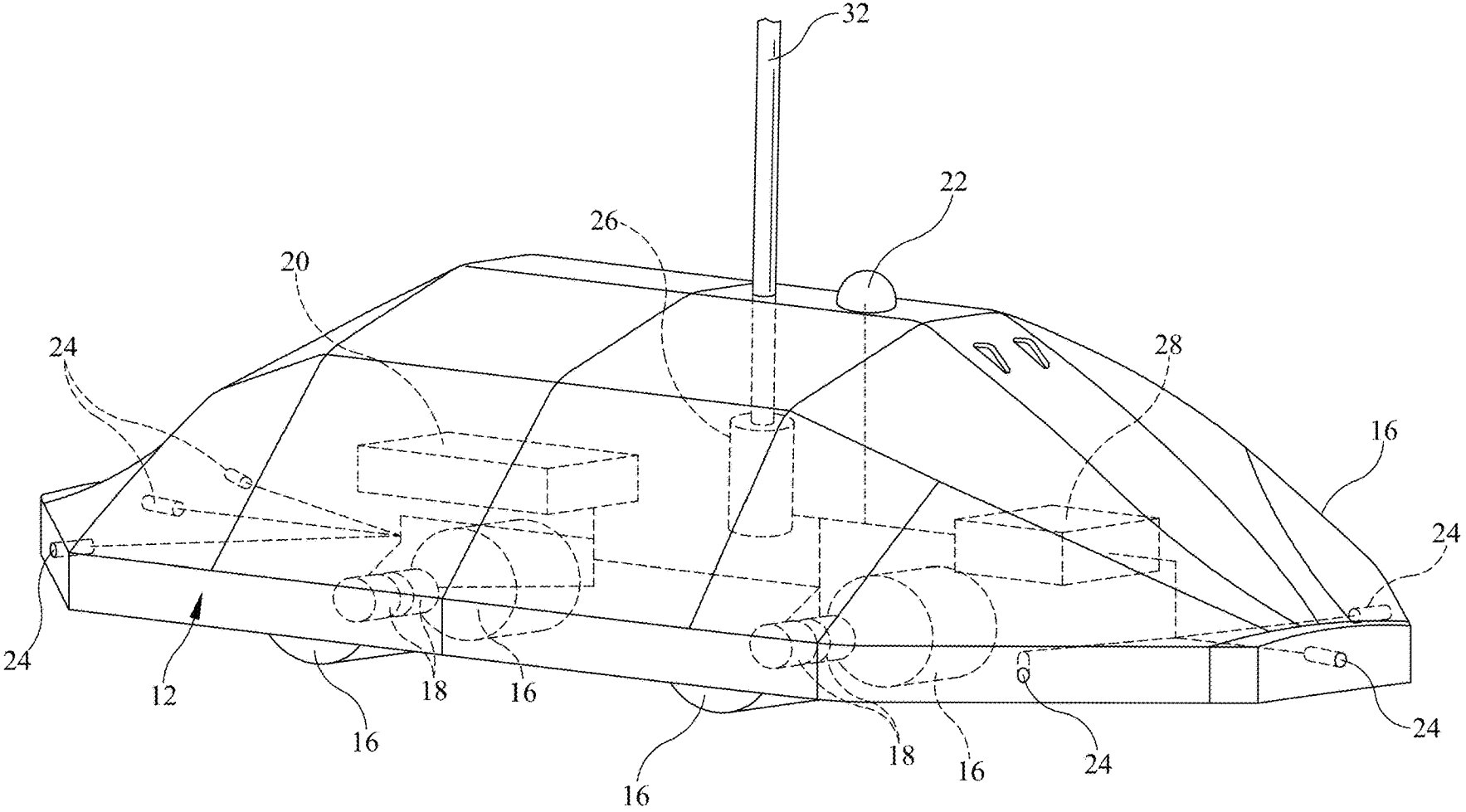
FIG. 2 is a close-up perspective view of the drone used by the ground drone-based sports training aid.
Figure 3:
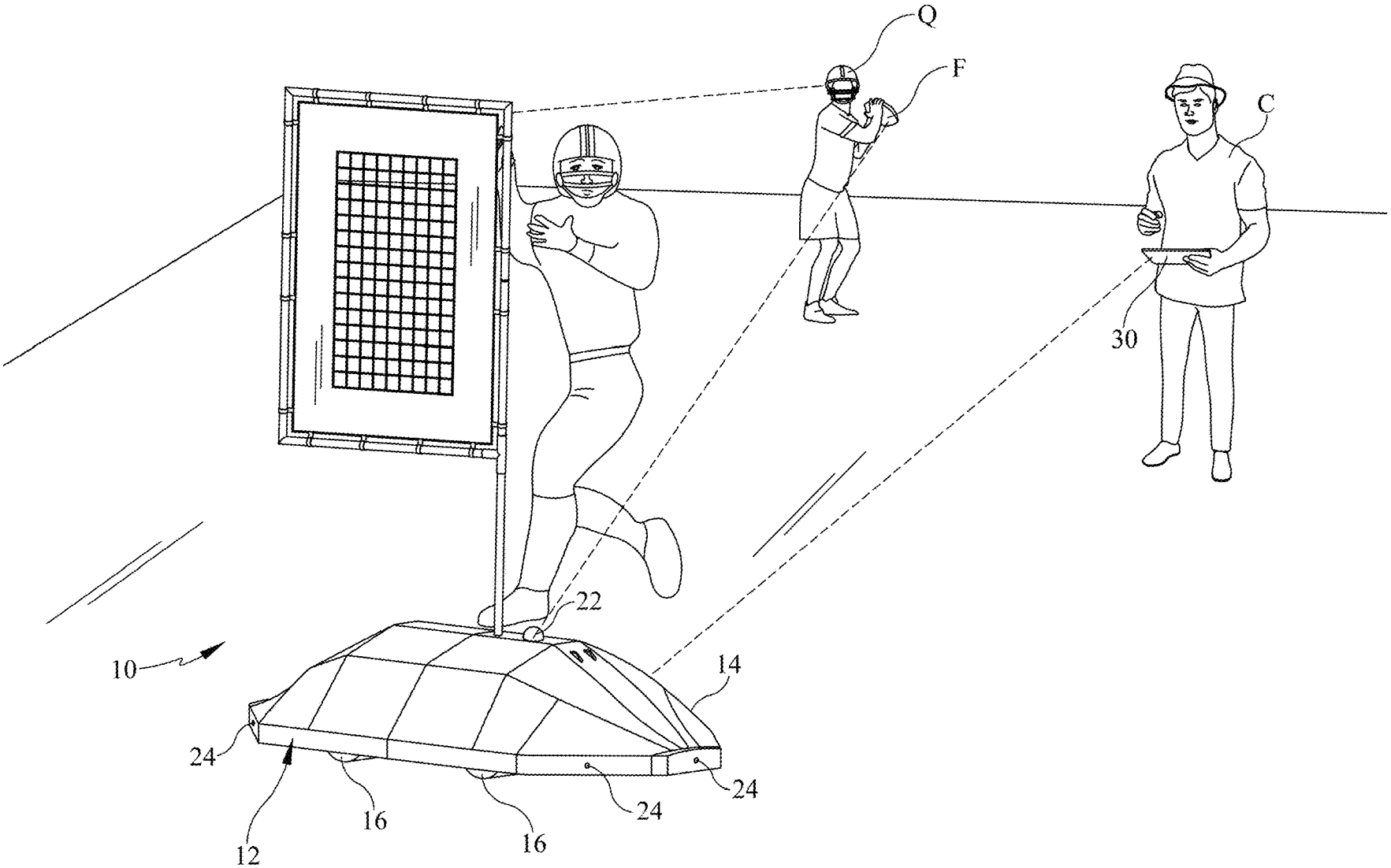
FIG. 3 is an environmental view of the ground drone-based sports training aid during the start of a pass play.
Figure 4:
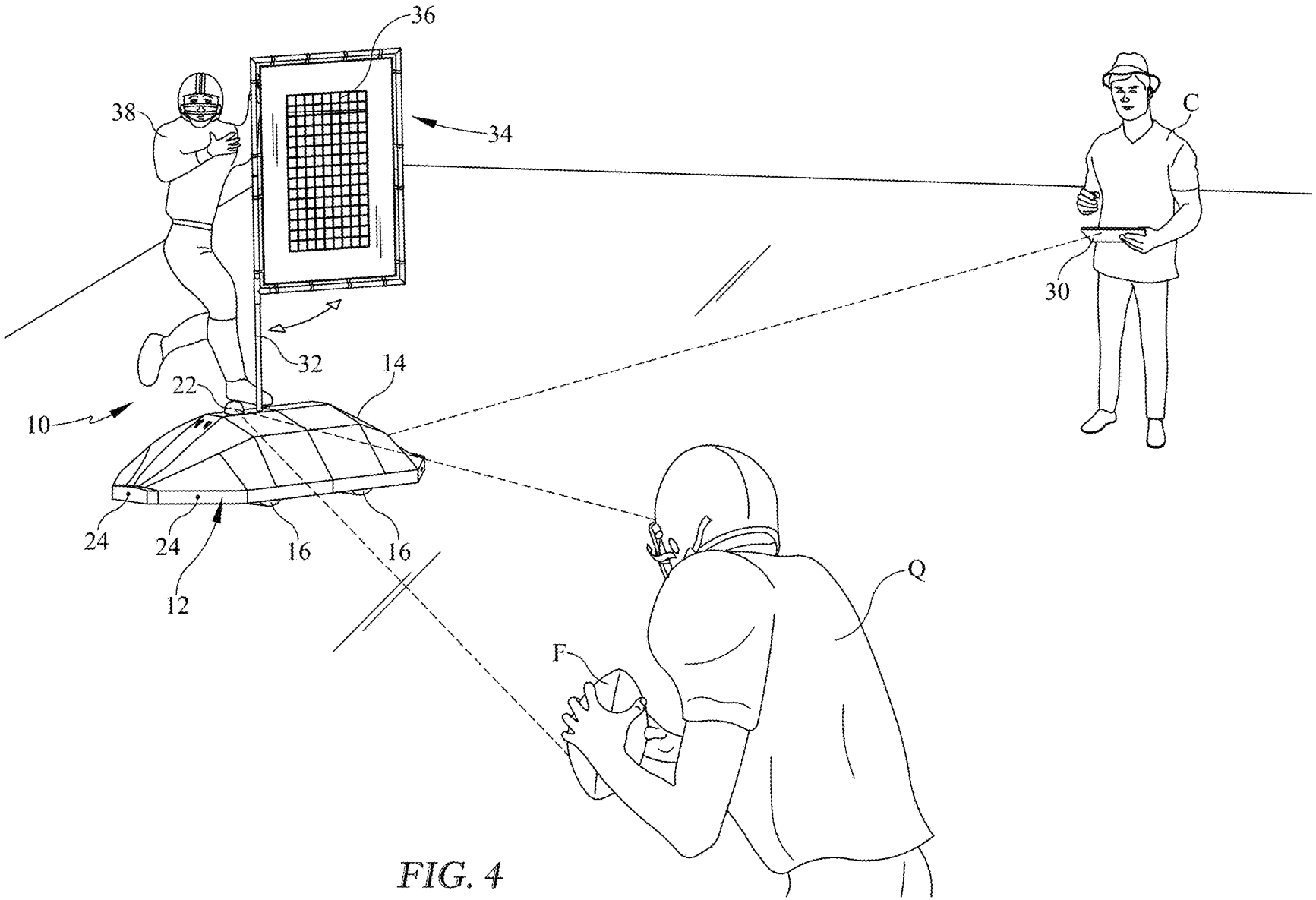
FIG. 4 is an environmental view of the ground drone-based sports training aid during the start of a pass play from the quarterback's perspective.
Figure 5:
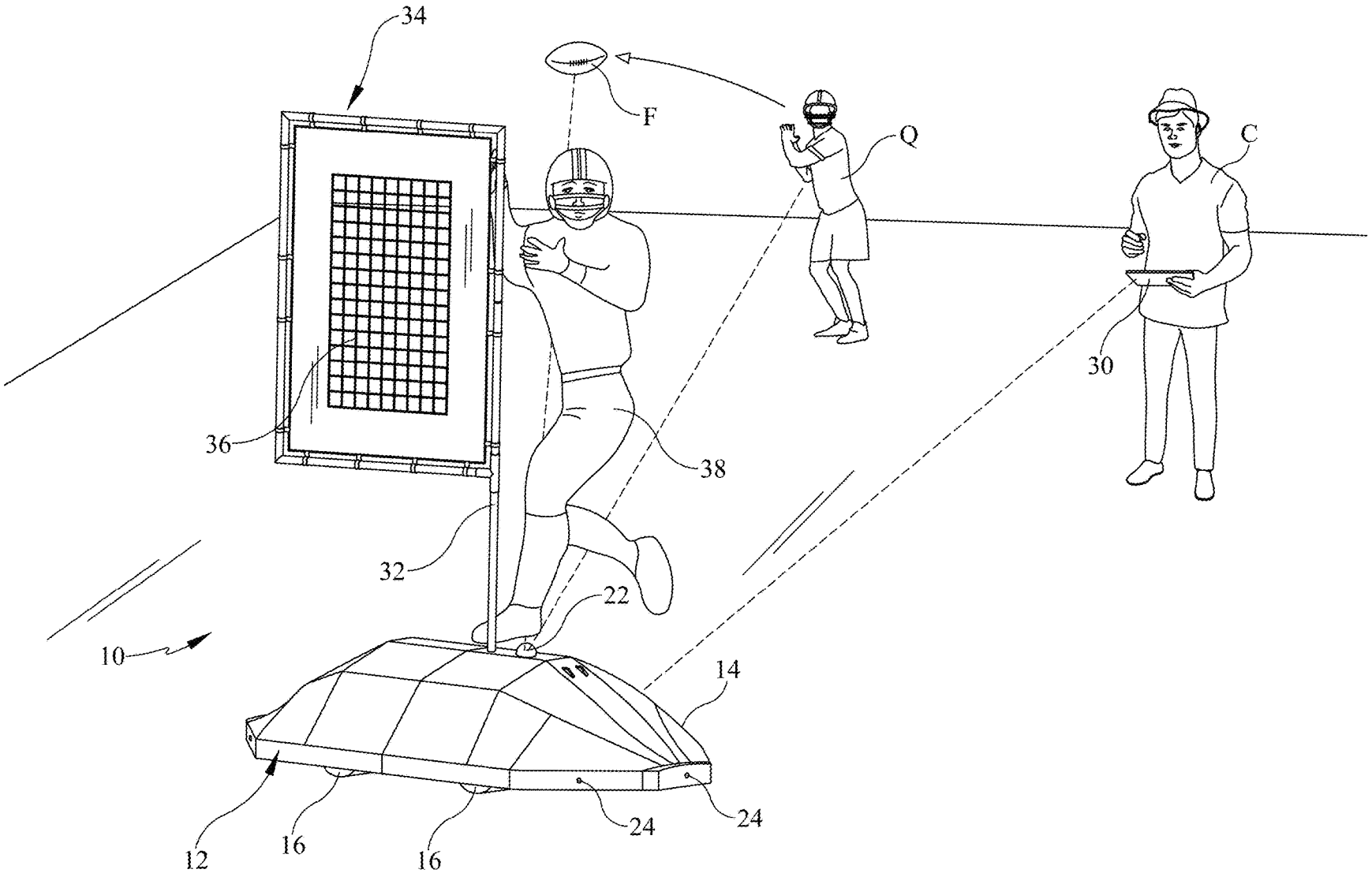
FIG. 5 is an environmental view of the ground drone-based sports training aid while the football is in flight.
Figure 6:
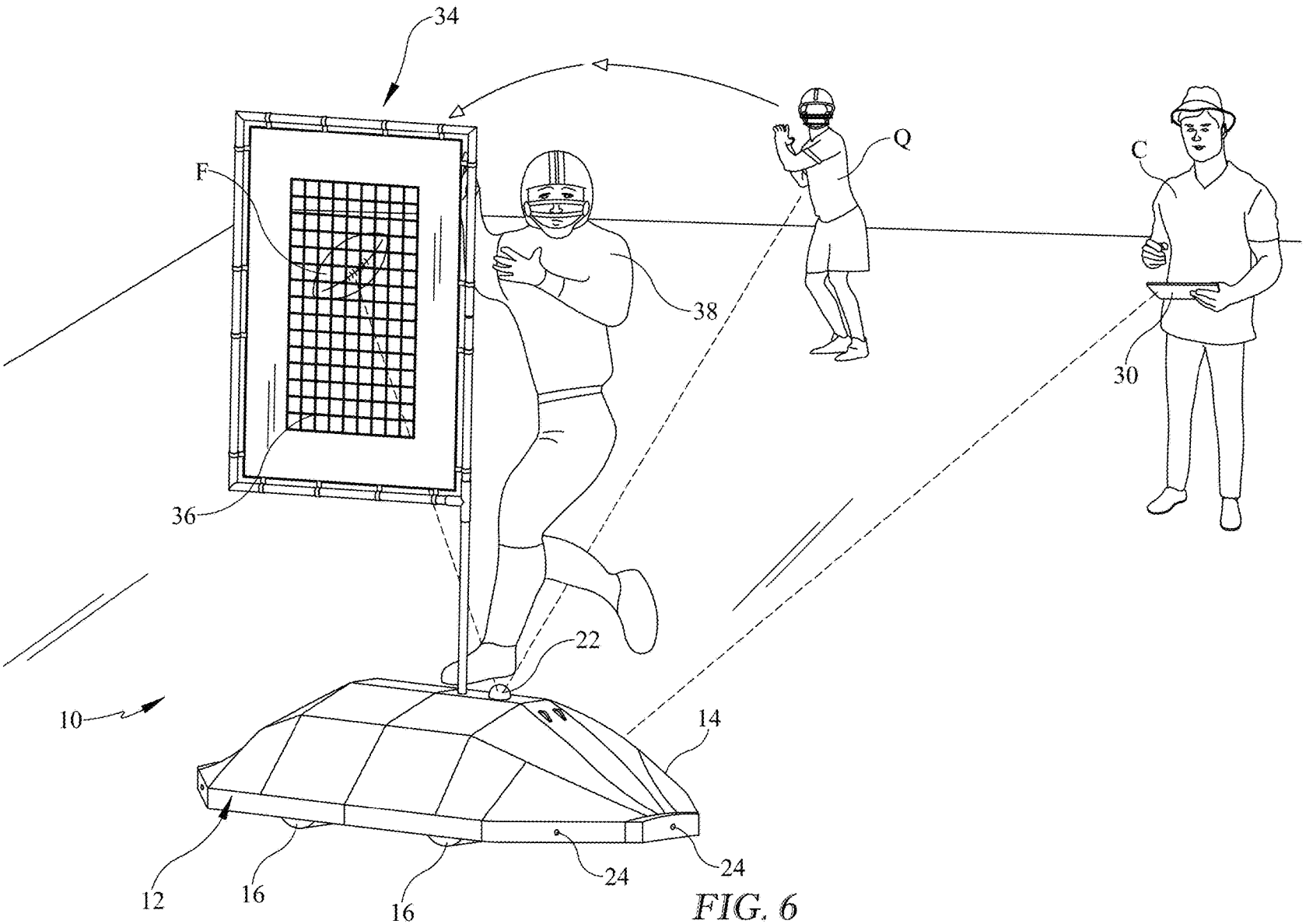
FIG. 6 is an environmental view of the ground drone-based sports training aid at the football's impact with the target.

Referring now to the drawings, it is seen that the ground drone-based sports training aid of the present invention, generally denoted by reference numeral 10, is comprised of a ground-based drone 12 which is comprised of a housing 14 that has a series of wheels 16. The wheels 16 are designed to be able to traverse a typical football field at the speeds of a pass catcher, which in the professional leagues, approaches 20 miles per hour. Advantageously, the wheels will be rubber or rubber encircled and may be pneumatic in order to be able to properly traverse a football practice field. While the device is illustrated with 4 wheels, the drone may have a two-wheel set and use an active balancing system as is known in the art, or of course, may have more than four wheels. At least one electric drive motor 18 is mechanically connected to at least one of the wheels 16 to provide locomotive power, although, advantageously, each motor is connected to at least a pair of opposing wheels. The drone may be equipped with an onboard dedicated steering system (not illustrated), however, for simplicity, the drone may be steered via variable power output (including reverse power) to the wheels 16 from the drive motors 18. A battery 20 is located within the housing 14 and is electrically connected to each drive motor 18 in order to provide a source of electric power to each drive motor 18. The battery 20 may be capable of being recharged directly within the drone 12 (recharging hardware not illustrated) or may be quickly and easily removed and replaced with a fresh battery 20 and recharged within a separate charging system (not illustrated), thereby allowing for minimal down time of the device when a given battery 20 is depleted.

A sensor pack 22 is strategically located on the drone 12 in a location that allows for maximum outward vision of the sensor pack 22. The sensor pack 22 has appropriate computer vision as well as speed detecting sensors therein that allow the sensor pack 22 to track and monitor objects as more fully explained below. Obstacle sensors 24 are located at appropriate spots at the front and back of the housing 14. A mast motor 26 is located within the housing 14. A control unit 28 is located within the housing 14 and is connected to the drive motors 18, the battery 20, the sensor pack 22, the obstacle sensors 24, and the mast motor 26. The control unit 28 is capable of sending and receiving control signals wirelessly from an appropriate handheld electronic device 30 (tablet, cellphone etc.,) via an appropriate protocol such as Wi-Fi, Bluetooth, etc. The battery 20 provides electric power to all units on the drone 12 so needing such electric power.

The drone 12 is shown with the housing 14 flared out from the wheels 16 (the wheels 16 are inset from the outer shell of the housing 14 at the location of each respective wheel 16). This design helps prevent the drone 12 from tipping over when hard cuts are made at high speed or the device is hit by a football F or other object. Of course, the housing can also be designed with a more traditional non-flared architecture and use a series of outriggers (not illustrated) or a similar device to assist with drone anti-tipping.

A mast 32 is connected to the output drive of the mast motor 26 (or may be attached proximate to the mast motor and gearably connected thereto) so that the mast motor 26 can rotate the mast 32 as needed and as more fully described below. A target 34 is located at the upper end of the mast 32 and may have a net 36 thereon for ease of football F retrieval. Although not needed for proper operation of the device, if desired, a representation of a pass catcher 38 can also be attached to the mast 32 for a more realistic appearance. The pass catcher 38 can be essentially two-dimension (flat plate member) or three-dimensional and may be similar in size to a typical pass catcher. Of course, the pass catcher silhouette can be the mast and target proper and have a net at an appropriate spot such as between the numbers, between the hands, etc.

In order to use the ground drone-based sports training aid 10 of the present invention, a coach C or even the quarterback Q programs a play into the handheld electronic device 30 and transmits the play to the control unit 28. The play is the route that is run by a pass catcher. The play may be selected from a library stored on the handheld electronic device 30 (or in the cloud) or may be manually programmed into the handheld electronic device by the coach C. Upon a start signal being initiated by the handheld electronic device 30, the drone 12 traverses the terrain and drives the route that was sent to the control unit 28. The control unit 28, via its onboard processor (not separately numbered), controls the output of each drive motor 18 so that the drone 12 travels along the path of the play programmed as well as at the speed programmed. The speed can be variable as needed. At the appropriate occasion during the play, the quarterback Q throws the football F trying to hit the target 34. The drone 12 can also be controlled manually so that after the play, the coach C can control the drone 12 so as to quickly position the drone 12 at the correct start position for the next play. If desired, a joystick type of controller (not illustrated) can be paired with the coach's handheld electronic device 30 for ease of manual control of the drone 12 during reset or during manual control of the drone 12 during execution of a play.

During drone 12 travel, any unexpected objects on the field play, such as a wayward player or other object, is detected by the drone 12 by one or more of the obstacle sensors 24 onboard the drone 12 so that the drone 12 can change course or simply stop in order to prevent collision with such wayward object and the possibility of causing damage to the drone 12 or injury to a person (remembering that the drone 12 can match the speed of a typical pass catcher that can run upwards of 20 MPH in short sprints).

Once the play is programmed into the handheld electronic device 30 and transmitted to the control unit 28, the computer vision sensors within the sensor pack 22 acquires visual contact with both the quarterback Q and the football F. Throughout the play, the sensor pack 22 maintains visual contact with the football F and the quarterback Q. The sensor pack 22 is a series of computer vision and speed tracking sensors that track the trajectory and speed of the football F and the quarterback Q. The output from the sensor pack 22, as well as the travel track of the drone 12 including its speed, is communicated to the control unit 28 and stored on an appropriate storage device on board the control unit 28. The stored data is transmitted, either play by play, and/or after the practice session to the handheld electronic device 30 where the data is fed into appropriate 3-D reconstruction software that allows for a 3-D onscreen representation of each play for analysis by appropriate personnel.

The sensor pack 22, which has omnidirectional vision, is located on an appropriate location of the housing 14 so that it continually sees the football F and quarterback Q with minimal interference from the mast 32. The sensor pack may be located atop the mast, however, such located is not ideal as the mast may be swapped out for a different mast (different size or shape of target) and such sensor pack placement would add undesired complexity to the unit.

During play execution, the mast motor 26 rotates the mast 32 so that the target 34 is constantly facing in a defined direction. The defined direction may be either a fixed direction (e.g., the target 34 constantly faces the initial position of the football on the line of scrimmage or at the end zone, etc.,) irrespective of the direction of travel of the drone 12 or at a specific object such as the quarterback Q. The control unit 28 controls rotation of the mast motor 26. The control unit 28 can use either the input from the sensor pack 22 which is seeing the quarterback Q and communicates the quarterback's position to the control unit 28 in order rotate the mast 32 appropriately, or the control unit can rotate the mast 32 via the mast motor 26 simply by signals the control unit 28 sends to the drive motors 18 to turn the mast 32 based on the steering commands the control unit 28 is issuing—the control unit 28 via its steering inputs knows the position and direction of the drone 12 at all times and based on such knowledge sends appropriate input commands to the mast motor for proper mast rotation to achieve the desired position of the target 34 onboard the mast 32.

The mast motor may also have the ability to raise and lower the mast through appropriate gearing of the mast motor (not illustrated) or a second motor (also not illustrated) may be provided for such function. The raising and lowering of the mast and its target allow for over-the-shoulder or between the numbers target placement for the quarterback Q or similar variations for the target.

While the invention has been particularly shown and described with reference to an embodiment thereof, it will be appreciated by those skilled in the art that various changes in form and detail may be made without departing from the spirit and scope of the invention.

We claim:

1. A training aid comprising:

a ground traversing drone having a series of wheels driven by a drive motor, the drone travels along a path preprogrammed into a control unit located onboard the drone, the control unit in communication with the drive motor such that the drone is steered in non-linear directions as needed in proceeding along the path;

a target located onboard the drone; and a sensor pack for tracking a speed and a trajectory of a first object remote from the drone.

2. The training aid as in claim 1 wherein the drone is steered by having the motor provide variable inputs into at least a subset of the series of wheels.

3. The training aid as in claim 1 wherein the drone is steered by an independent steering assembly connected to at least a subset of the wheels.

4. The training aid as in claim 1 wherein the drive motor is electric.

5. The training aid as in claim 1 wherein the target rotates so as to be constantly facing in a defined direction.

6. The training aid as in claim 5 wherein the defined direction is a fixed direction.

7. The training aid as in claim 5 wherein the defined direction is a variable direction based on a location of a second object that moves along the ground.

8. A training aid comprising:

a steerable, non-track-mounted ground traversing drone having a series of wheels driven by a drive motor, the drone travels along path preprogrammed into a control unit located onboard the drone, the control unit in communication with the drive motor;

a target located onboard the drone; and a sensor pack for tracking a speed and a trajectory of a first object remote from the drone.

9. The training aid as in claim 8 wherein the drone is steered by having the motor provide variable inputs into at least a subset of the series of wheels.

10. The training aid as in claim 1 wherein the drone is steered by an independent steering assembly connected to at least a subset of the wheels.

11. The training aid as in claim 8 wherein the drive motor is electric.

12. The training aid as in claim 8 wherein the target rotates so as to be constantly facing in a defined direction.

13. The training aid as in claim 12 wherein the defined direction is a fixed direction.

14. The training aid as in claim 12 wherein the defined direction is a variable direction based on a location of a second object that moves along the ground.

15. A training aid comprising:

a steerable ground traversing drone having a series of wheels driven by a drive motor, the drone travels along a first path preprogrammed into a control unit located onboard the drone, the control unit in communication with the drive motor;

a target located onboard the drone, the target rotates in response to the position of the drone on the first path upon which the drone is traveling so that the target is constantly facing a defined direction; and a sensor pack for tracking a speed and a trajectory of a first object remote from the drone.

16. The training aid as in claim 15 wherein the drone is steered by having the motor provide variable inputs into at least a subset of the series of wheels.

17. The training aid as in claim 15 wherein the drone is steered by an independent steering assembly connected to at least a subset of the wheels.

18. The training aid as in claim 15 wherein the drive motor is electric.

19. The training aid as in claim 15 wherein the defined direction is a single fixed direction.

20. The training aid as in claim 15 wherein the defined direction is a variable direction based on a location of a second object that moves along the ground in a second path that is different relative to the first path.

* * * * *